US007510238B2

(12) United States Patent
McClintock et al.

(10) Patent No.: US 7,510,238 B2
(45) Date of Patent: Mar. 31, 2009

(54) INTERACTIVE ENTERTAINER

(75) Inventors: Christa McClintock, San Francisco, CA (US); Kathleen Campisano, Danville, CA (US); Stephanie Elias, San Francisco, CA (US); Kim Voskuil, Green Bay, WI (US); Stuart Kurdi, Mountain View, CA (US); Michael Perkins, Santa Clara, CA (US); Michael C. Dorsey, Irvine, CA (US); Andrew B. Mendenhall, Indianapolis, IN (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 505 days.

(21) Appl. No.: 10/966,142

(22) Filed: Oct. 15, 2004

(65) Prior Publication Data

US 2005/0140185 A1 Jun. 30, 2005

Related U.S. Application Data

(60) Provisional application No. 60/512,242, filed on Oct. 17, 2003.

(51) Int. Cl.
*A47B 83/02* (2006.01)
*A47C 7/62* (2006.01)

(52) U.S. Cl. ..... 297/137; 297/217.3; 297/217.1

(58) Field of Classification Search ..... 482/66, 482/68; 297/136, 137, 5, 6, 217.4, 217.3, 297/344.21, 344.22, 344.23, 183.5, 183.1, 297/16.2; 434/433; 108/50.11, 162, 176, 108/127, 186, 59, 94; 385/147
See application file for complete search history.

(56) References Cited

U.S. PATENT DOCUMENTS

| | | | | | |
|---|---|---|---|---|---|
| 1,215,479 | A * | 2/1917 | Burrowes | ..... | 108/127 |
| 2,145,201 | A * | 1/1939 | Raeuber | ..... | 297/142 |
| 2,812,012 | A * | 11/1957 | Hansburg | ..... | 297/137 |
| 5,451,093 | A * | 9/1995 | Petrie et al. | ..... | 297/137 |
| 5,480,210 | A * | 1/1996 | Lehenbauer et al. | ..... | 297/137 |
| 5,518,475 | A * | 5/1996 | Garland | ..... | 482/68 |
| 5,688,211 | A * | 11/1997 | Myers | ..... | 482/66 |
| 5,728,030 | A * | 3/1998 | Hsieh | ..... | 482/66 |
| 6,637,814 | B1 * | 10/2003 | Bellows et al. | ..... | 297/137 |
| 6,896,575 | B2 * | 5/2005 | Fair et al. | ..... | 446/227 |
| 2007/0265144 | A1 * | 11/2007 | Jackson et al. | ..... | 482/68 |

* cited by examiner

*Primary Examiner*—Milton Nelson, Jr.
(74) *Attorney, Agent, or Firm*—Townsend and Townsend and Crew

(57) ABSTRACT

An interactive entertainer having a lower tray with a plurality of compressible legs supporting an upper tray. The lower tray is concave to permit rocking of the tray when placed on a flat surface. One or more supports coupled to the lower tray may be repositioned to inhibit rocking of the lower tray. The legs can fold into the lower tray following separation of the upper tray. The lower tray can then nest within the upper tray to provide compact storage. The upper tray can support a seat that is selectively rotatable or stationary based on a position of a seat lock. A plurality of interactive devices may be positioned on the upper tray. One or more sensors may be positioned relative to the seat to detect the orientation of the seat relative to the devices. The devices may be selectively enabled based on the seat orientation.

23 Claims, 14 Drawing Sheets

INTERACTIVE ENTERTAINER

CROSS-REFERENCES TO RELATED APPLICATIONS

This application claims the benefit of U.S. Provisional Application No. 60/512,242 filed Oct. 17, 2003, and entitled SEAT APPARATUS INCLUDING TRAY, which is hereby incorporated herein in its entirety.

BACKGROUND OF THE INVENTION

Learning and developmental devices are often used to stimulate children. Young children, particularly infants and toddlers, are rapidly developing mentally as well as physically. Continued stimulation and interaction is considered vital in the continued physical and mental development of an infant or toddler. Numerous devices are available to stimulate early development.

An infant progresses physically according to fairly predictable milestones. An infant typically initially develops the ability to support his or her own head and later develops the ability to roll over, sit unsupported, crawl, stand, and walk. Concurrently an infant typically develops eyesight, hand-eye coordination, and other motor skills.

Young children typically also experience tremendous levels of mental development. Young children develop their memory and language skills. Additionally, although less quantifiable, young children develop emotionally and socially.

Toys and developmental activities are often configured to provide only limited stimulus to young children, such as infants and toddlers. Each toy or activity may only provide limited stimulation through a narrow set of interactions. It is desirable for a toy to have increased functionality and the ability to integrate physical and mental development.

Also, many toys and developmental devices are large and bulky. For example, it is difficult if not impossible for many commercially available saucers to fit into the trunk of a standard sedan or hatchback. It would be desirable to provide for an interactive entertainer that is easily transportable, as well as fun and interactive.

Embodiments of the invention address these problems individually and collectively.

BRIEF SUMMARY OF THE INVENTION

An interactive entertainer having a lower tray with a plurality of compressible legs supporting an upper tray is disclosed. The lower tray can be concave to permit rocking of the tray when placed on a flat surface. One or more supports coupled to the lower tray may be repositioned to inhibit rocking of the lower tray. The legs can fold into the lower tray following separation of the upper tray. The lower tray can then nest within the upper tray to provide compact storage. Conversely, the upper tray can be separated from the lower tray and assembled to transform the interactive entertainer from a compact storage mode to an active or operational configuration. The upper tray can support a seat that is selectively rotatable or stationary based on a position of a seat lock. A plurality of interactive devices may be positioned on the upper tray. One or more sensors may be positioned relative to the seat to detect the orientation of the seat relative to the devices. The devices may be selectively enabled based on the seat orientation.

One aspect of the invention includes an interactive entertainer including a lower tray, a seat, and an upper tray disposed around at least a portion of the seat and disposed above the lower tray, and configured to allow the seat to rotate relative to the upper tray, the interactive entertainer capable of being transformed from an activity mode to a storage mode by collapsing the upper tray towards the lower tray to reduce the overall dimensions of the interactive entertainer.

Another aspect of the invention includes an interactive entertainer including a seat, a tray disposed around at least a portion of the seat, at least one interactive device positioned on the tray, and an interactive book having at least one page and positioned on the tray and coupled to the at least one interactive device, wherein turning the page of the interactive book changes an operational mode of the interactive entertainer.

Another aspect of the invention includes an interactive entertainer including a seat, a tray disposed around at least a portion of the seat and configured to allow the seat to rotate relative to the tray, at least one device positioned on the tray, and a sensor configured to monitor at least a portion of the seat and configured to determine an orientation of the seat.

Another aspect of the invention includes an interactive entertainer including a seat, a tray disposed around at least a portion of the seat and configured to allow the seat to rotate relative to the tray, and at least one device positioned on the tray and configured to rotate based in part on rotation of the seat.

Another aspect of the invention includes a method of configuring an interactive entertainer to a travel mode. The method includes releasing an upper tray supporting a rotatable seat and at least one interactive device from at least one support, configuring the at least one support for the travel mode, collapsing the upper tray towards a lower tray, and coupling the upper tray to the lower tray when collapsed to configure the interactive entertainer to the travel mode.

BRIEF DESCRIPTION OF THE DRAWINGS

The features, objects, and advantages of embodiments of the disclosure will become more apparent from the detailed description set forth below when taken in conjunction with the drawings, in which like elements bear like reference numerals.

DETAILED DESCRIPTION OF EMBODIMENTS OF THE INVENTION

Figure 1:
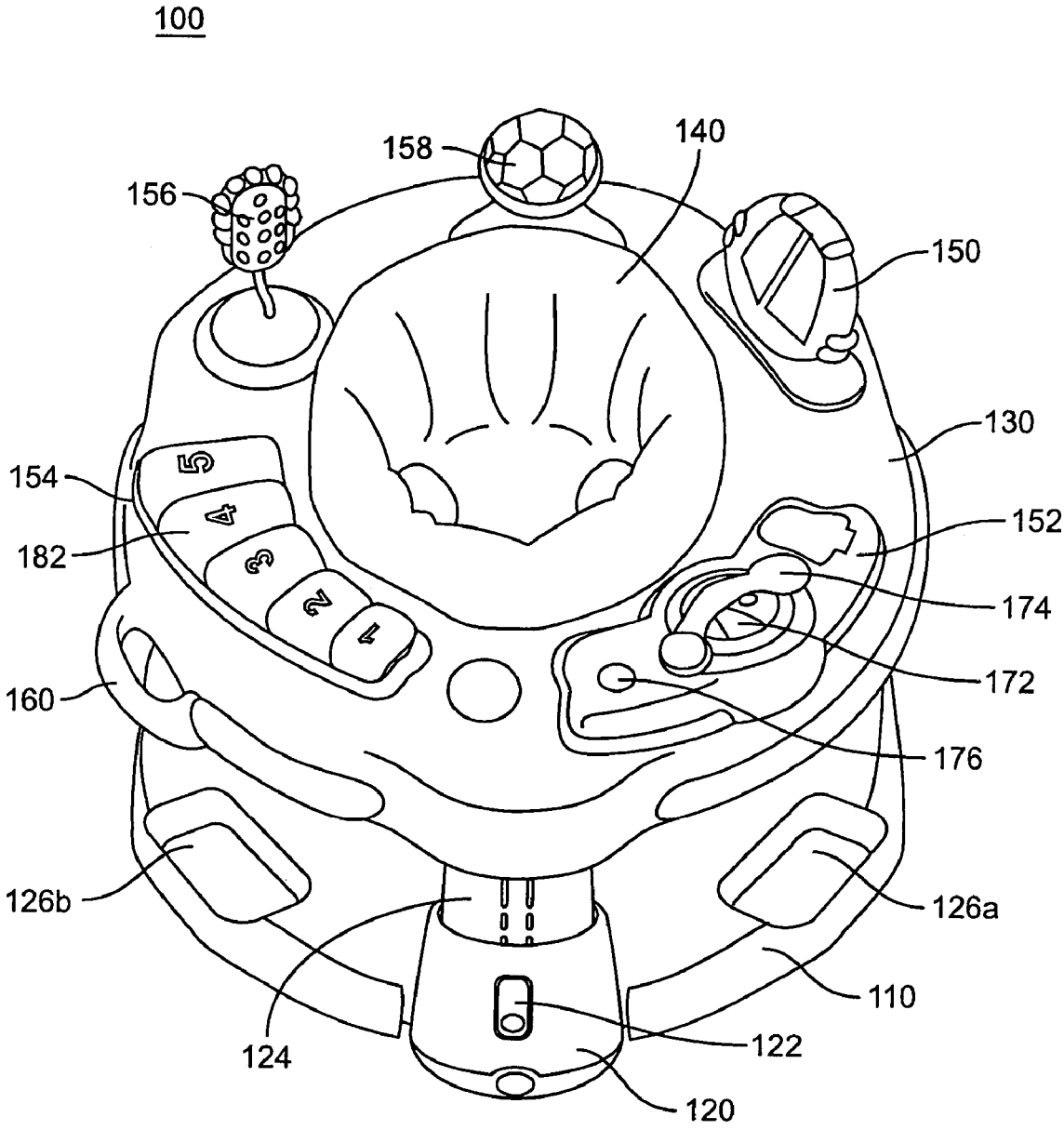
FIG. 1 is a plan view of an embodiment of an interactive entertainer.

An interactive entertainer can be configured to provide mental and physical stimulation and enhance mental and physical development in an infant, toddler, or child. An interactive entertainer similar to an exercise saucer or walker can be configured to provide numerous interactive stimuli. For example, the interactive entertainer may be configured as a stationary entertainer in the form of an exercise saucer. In another embodiment, the interactive entertainer may be configured as a mobile entertainer in the form of a walker. The stimuli can be configured in the form of interactive games or toys positioned about the interactive entertainer. The activities positioned on the interactive entertainer can help to develop fine and gross motor skills while teaching infants, for example, the alphabet, numbers, counting, colors, language development, and cause and effect.

In one embodiment, the interactive entertainer includes a lower tray with a plurality of legs supporting a removable upper tray. The lower tray is typically configured to rest upon a relatively flat surface such as the ground. The lower tray can be convex in shape, relative to a point above the ground, such that the interactive entertainer can rock when placed on a relatively flat surface. One or more supports may be positioned to selectively project beneath portions of the lower tray to prevent the rocking ability of the interactive entertainer.

The legs can be configured to be repositioned to allow for more compact storage or transport. For example, each of the legs can be attached to the lower tray via a hinge, pivot, or some other rotatable mount that allows the leg to be folded. In one embodiment, the legs can be folded to lie within the outline of the lower tray when the upper tray is separated form the legs.

The lower tray can also be configured to couple with the upper tray when the interactive entertainer is configured for storage or transport, such as in a travel mode. The lower tray can be configured to nest within an opening or recess of the upper tray once the legs are folded to lie within the lower tray.

The upper tray can include numerous games, toys, or interactive devices positioned around a central opening. The central opening can be configured to support a seat into which a child may be placed. The seat can be configured to rotate relative to the upper tray, and can be configured to rotate 360 degrees relative to the upper tray. The seat or a seat mount can be mechanically coupled to one or more of the devices positioned on the upper tray such that rotation of the seat can cause a corresponding movement in one or more devices. For example, the rotation of the seat can result in a rotation of a device mounted on the upper tray. The upper tray can include a lock or brake to fix the location of the seat relative to the upper tray.

The upper tray can also include one or more sensors that cooperate with one or more sensors that are coupled to the seat. The sensors can be used to determine a seat orientation and selectively activate or deactivate one or more of the devices positioned on the upper tray depending on the seat orientation. Alternatively, the sensors can use the seat orientation to enable particular functions associated with one or more of the devices positioned on the upper tray.

FIG. 1 is a plan view of an embodiment of an interactive entertainer 100. The embodiment of the interactive entertainer 100 is configured as an exercise saucer for an infant or toddler having a plurality of interactive devices accessible to an infant located within the interactive entertainer 100.

The interactive entertainer 100 includes a lower tray 110 that is mechanically coupled to at least one leg 120 that provides support for an upper tray 130. Both the upper tray 130 and the lower tray 110 are shown as substantially circular in shape. However, each tray may have a different shape and the outline of the upper tray 130 does not need to track that of the lower tray 110, although it may be advantageous to do so. Although only one leg 120 can be seen in the view of FIG. 1, additional legs may also be coupled to the lower tray 110 and may provide additional means for supporting the upper tray 130. In other embodiments, the legs, for example 120, may be mechanically coupled to the upper tray 130 and may extend down to releasably mate with the lower tray 110.

Each leg 120 can include a leg extension 124 that interfaces with a leg attachment (not shown) on the upper tray 130. The leg extension 124 can mate, for example, with the leg attachment on the upper tray 130 and can be detached from the upper tray 130. The leg extension 124 can be extended or contracted relative to the leg 120 to vary the height of the upper tray 130. A release 122 positioned on each leg 120 can be used to selectively release or secure the leg extension 124. The release 122 can be coupled, for example, to a detent, captured ball, pin, hook, receptacle, and the like, or some other means for releasably securing the leg extension 124. Although the release 122 is shown as positioned on the leg 120, alternative embodiments may position the release 122 on the leg extension 124.

The lower tray 110 can also include one or more nesting areas 126*a*-126*b* that are configured to provide a space for the leg attachments (not shown) on the upper tray 130 when the lower tray 110 and upper tray 130 are positioned in a travel or storage mode that will be discussed in further detail below.

The upper tray 130 can include an opening that is configured to receive and support a seat 140 or seat support, such as a seat ring. The seat 140 can be configured to rotate relative to the upper tray 130 such that a child located within the seat can face any direction relative to the upper tray 130. Alternatively, the seat 140 can be configured to have a reduced range of rotation that does not allow the seat 140 to be rotated completely around. The upper tray 130 can also include a handle 160 that is configured to be accessible in the storage or travel mode to provide a convenient carrying point for the interactive entertainer 100.

One or more devices 150, 152, 154, 156, and 158 can be positioned on the upper tray 130. Advantageously, the one or more devices 150, 152, 154, 156, and 158 are positioned to be within reach of a child located within the seat 140 for certain seat orientations. The one or more devices 150, 152, 154, 156, and 158 can be interactive devices that can provide a stimulus and that may be responsive to interaction. One or more of the devices 150, 152, 154, 156, and 158 can be passive devices, such as globes or rattles, that do not include electronics. Additionally, one or more of the devices 150, 152, 154, 156, and 158 can be an active device that includes or interfaces with electronics to provide enhanced stimulation or interactive experience.

For example, the devices 150, 152, 154, 156, and 158 can include an interactive book 150 such as the ones described in U.S. patent application Ser. No. 10/336,239, filed Jan. 3, 2003, entitled LEARNING CENTER, which is hereby incorporated herein in its entirety. The interactive book 150 maybe configured such that an operational mode of the interactive entertainer 100 is determined in part on which page of the interactive book 150 is displayed. In such an embodiment, turning the pages of the interactive book 150 changes the operational mode of the interactive entertainer 100. For example, the interactive book 150 may control the interactive entertainer 100 to switch between a learning operational mode and a music operational mode.

A simulated record player 152 can also be positioned on the upper tray 130 and can perform one or more predetermined actions based on inputs. In one embodiment, the simulated record player 152 may spin a simulated record 172 and play a tune when a record handle 174 is pulled. In the learning mode, the simulated record player 152 can play familiar learning songs such as an alphabet song when activated. In the music mode, the simulated record player 152 can play instrumental tunes in a dance style. A volume slide 176 may be configured to vary the volume associated with the simulated record, or may be a dummy volume slide that has no effect on the actual volume of the tune played when the simulated record player 152 is activated.

A keyboard 154 or keypad can also be positioned on the upper tray 130. The keyboard 154 can have multiple keys, for example 182, that can be configured to light and initiate an action when depressed. Each key can be a translucent key having a number or letter molded, embossed, painted, or otherwise associated with the key. A light source (not shown) can be configured to illuminate the key. For example, a key 184 may light and cause a speaker (not shown) to provide an audio output. The audio output may be, for example, a song, a tone, or a voice recording stating a number or a color depending on the operational mode of the interactive entertainer 100.

In the learning mode, the keyboard 154 can be configured to teach number sequencing, and the translucent keys may light when depressed. In the music mode, the keys may light when depressed and activation of a key may cause a musical riff to be played.

A microphone or simulated microphone 156 can also be positioned on the upper tray 130. A microphone can be configured to amplify a speaker's voice when the microphone is activated. A simulated microphone 156 can be configured as an input device that initiates an audio output, such as a tune or phrase, when pulled, rotated, or otherwise activated. The audio output initiated by the simulated microphone 156 may be determined based on the operational mode of the interactive entertainer 100.

A globe or geometric shape, such as a faceted globe 158, alternatively referred to as a disco ball, can also be positioned on the upper tray 130. The faceted globe 158 can be configured to rotate, and can be configured to rotate when the seat 140 is rotated. The faceted globe 158 can also be coupled to electronic switches, contacts, or circuits that provide an output in response to predetermined inputs. For example, the faceted globe 158 may be configured to selectively open or close an associated set of electrical contacts (not shown) that initiate an output when the state of the contacts is changed. Pulling or pushing on the faceted globe 158 can initiate an audio output that can vary depending on the direction the faceted globe 158 is deflected and on the operational mode of the interactive entertainer 100. In the learning mode, the faceted globe 158 may teach the concept of spinning around and in the music mode, activating the faceted globe 158 may cause an instrumental riff to be played.

Figure 2:
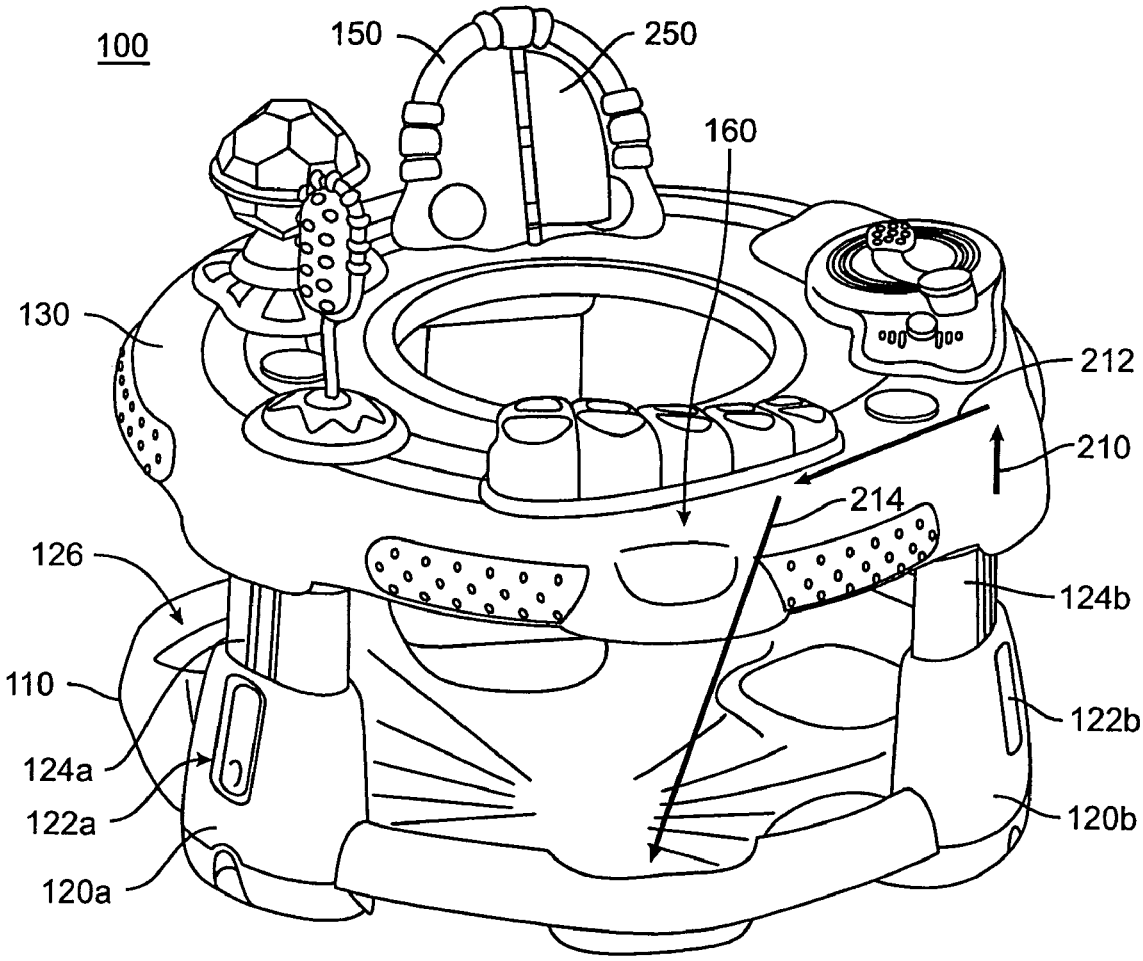
FIG. 2 is another plan view of an embodiment of an interactive entertainer.

FIG. 2 is another view of an embodiment of the interactive entertainer 100. In FIG. 2, the interactive entertainer 100 is shown with the seat and seat ring removed for purposes of clarity. The view of FIG. 2 more clearly shows the concave shape of the lower tray 110. In the embodiment shown in FIG. 2, the lower tray 110 is not a uniform concave surface. Instead, the lower tray 110 includes ridges or ribs that contribute to an overall concave outline that allows the interactive entertainer 100 to rock when placed on a relatively flat surface.

FIG. 2 also shows multiple legs 120*a* and 120*b*, each having a corresponding release, 122*a* and 122*b*. Each leg 120*a* and 120*b* also supports a leg extension 124*a* or 124*b* that couples to the upper tray 130.

The nesting areas, for example 126, configured to provide a space for the leg attachments (not shown) on the upper tray 130. The process of re-configuring the interactive entertainer 100 to a travel mode is illustrated by arrows in FIG. 2. The assembled interactive entertainer 100 is initially partially disassembled by releasing the upper tray 130 leg attachments (not shown) from each of the corresponding leg extensions 124*a*, 124*b*. Each of the legs 120*a*-120*b* are then folded to lie substantially horizontally within the lower tray 110. The uncoupled upper tray 130 can then be rotated relative to the lower tray 110 to align the leg attachments on the underside of the upper tray 130 with the nesting areas 126 of the lower tray 110 to allow for a more compact form.

Thus, to transform the interactive entertainer from an activity mode to a travel mode, one can release the upper tray from the legs (210), rotate the upper tray 130 such that the leg attachments align with the nesting areas (212), and collapse the upper tray 130 with the lower tray 110 until the two interlock (214). The legs 120*a*-120*b* can be folded radially inward to allow the upper and lower trays to collapse together. The lower tray 110 may then partially nest within the upper tray 130.

FIG. 2 also more clearly shows an embodiment of the interactive book 150 showing a page 250 that can be turned to change the operational mode of the interactive entertainer 100. The page 250 can include an image that corresponds to the operational mode. Turning the page 250 from the left hand side of the interactive book 150 to the right hand side can change the operational mode from, for example, a learn mode to a music mode.

Figure 3:
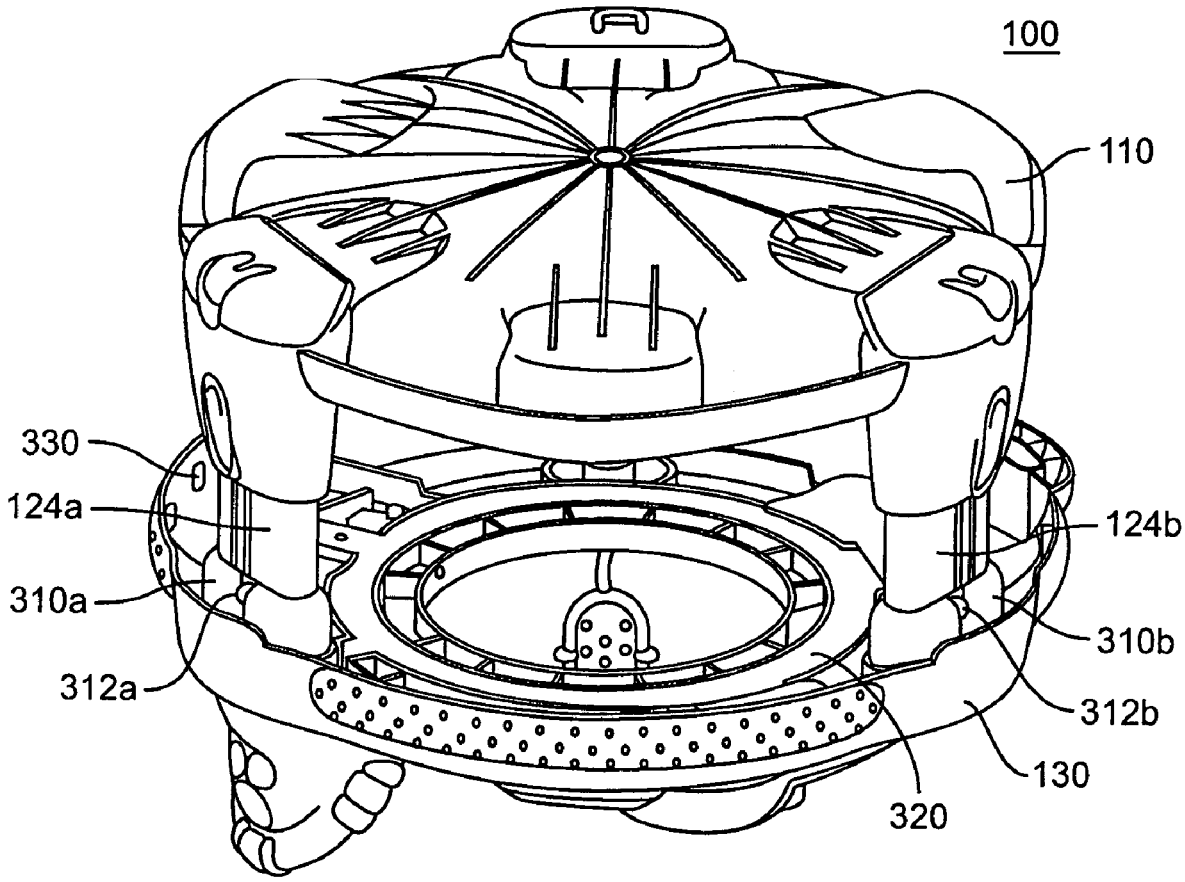
FIG. 3 is another plan view showing the underside of an embodiment of an interactive entertainer.

FIG. 3 is an underside view of an embodiment of the interactive entertainer 100 with the seat and seat ring removed for purposes of clarity. The underside view shows leg attachments 310*a* and 310*b* that are configured to mate with the leg extensions 124*a* and 124*b*. Each of the leg attachments 310*a* and 310*b* includes a corresponding release 312*a* or 312*b* that allows the leg attachments 310*a* and 310*b* to be released from the leg extensions 124*a* and 124*b*, thereby decoupling the upper tray 130 from the lower tray 110.

The leg attachments 310*a*-310*b* can be rigid or may be compliant or compressible. In one embodiment, the leg attachments 310*a*-310*b* rigidly couple the leg extensions 124*a*-124*b* to the upper tray 130. In another embodiment, the leg attachments 310*a*-310*b* may be compliant. For example, each leg attachment, for example 310*a*, can include a spring loaded leg mount. The spring loaded leg mount can allow the leg attachments 310*a*-310*b* to compress as a child placed in the seat bounces up and down. The spring loaded leg mounts within the leg attachments 310*a*-310*b* can cushion the shock experienced by the user when bouncing up and down. Additionally, the spring loaded leg mounts within the leg attachments 310*a*-310*b* can contribute to the bouncing motion imparted by the child.

One or more tabs 330 can be positioned on the underside of the upper tray 130 to engage with complementary receptacles or ridges on the lower tray 110 to capture the lower tray to the upper tray 130 when the interactive entertainer 100 is configured in the travel mode. In one embodiment, the upper tray 130 may be slightly flexed or distorted to disengage the upper tray 130 from the lower tray 110 when re-configuring the interactive entertainer 100 from the travel mode to a mode assembled for use.

The upper tray 130 includes an electronics cover 320 that is used to cover the cables, wiring, bus, or electronic circuit boards used to interconnect the various active elements positioned on the upper tray 130. In the embodiment shown in FIG. 3, the electronics cover 320 has a ring shape to cover the cabling and wiring used to couple the devices placed around the periphery of the upper tray 130.

Figure 4:
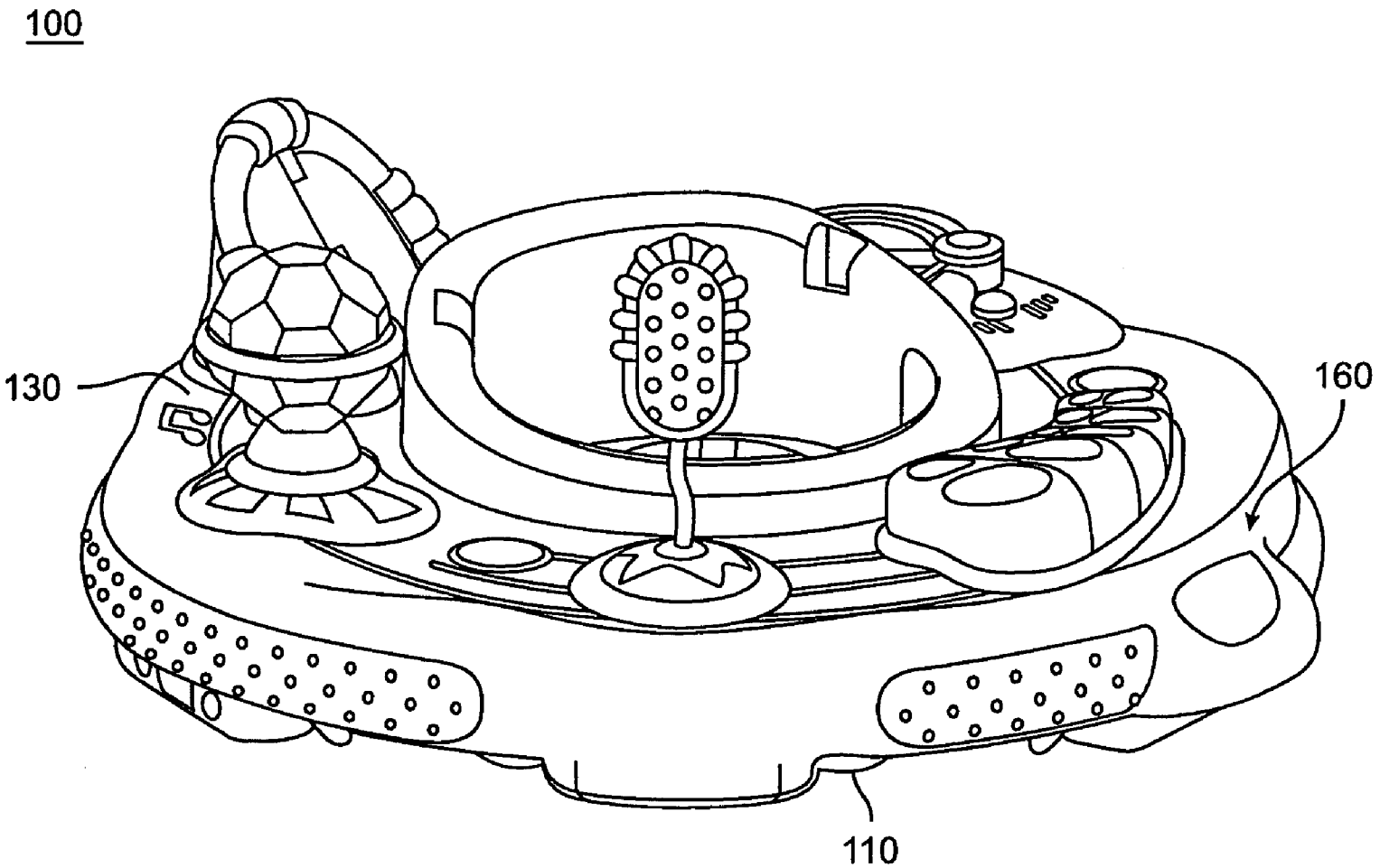
FIG. 4 is another plan view of an embodiment of an interactive entertainer configured in a travel mode.

FIG. 4 is a view of an embodiment of the interactive entertainer 100 configured in the travel mode. The handle 160 remains accessible to provide a carrying point for the interactive entertainer 100. In the embodiment of FIG. 4, the lower tray 110 is substantially nested within the upper tray 130 in the travel mode. Of course, the interactive entertainer 100 can be designed to have other travel mode configurations. For example, in other embodiments of the travel mode, a portion of the lower tray 110 may nest within the upper tray 130, the upper tray 130 may nest substantially or partially in the lower tray 110, or the upper and lower tray 130 and 110 may mechanically couple but may not nest together.

Figure 5:
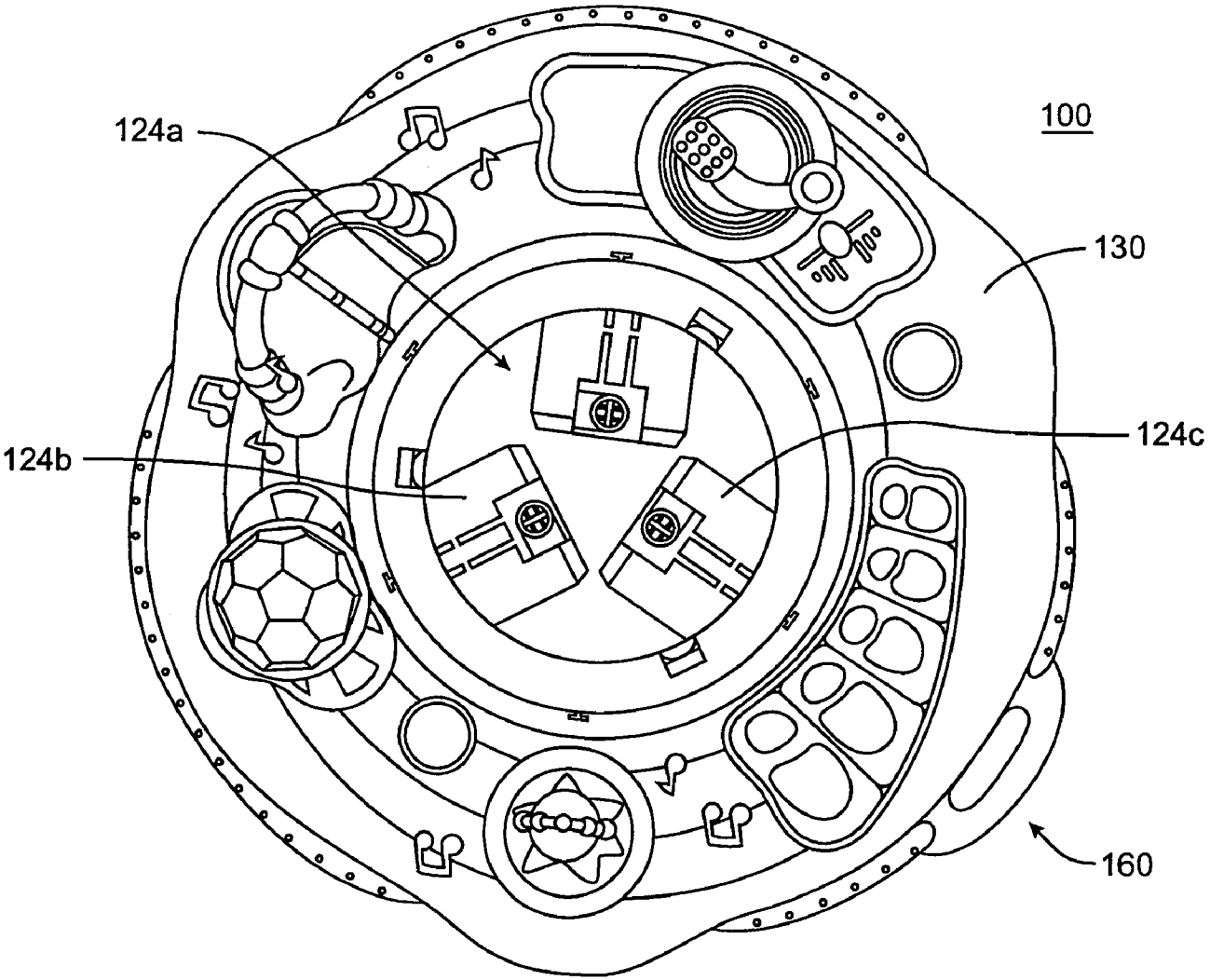
FIG. 5 is a top view of an embodiment of an interactive entertainer configured in a travel mode.

FIG. 5 is an overhead view of an embodiment of the interactive entertainer 100 configured in the travel mode. The view is with the seat removed to allow the leg extensions 124*a*-124*c* to be seen through the seat opening in the upper tray 130. The leg extensions 124*a*-124*c* can be seen to lie substantially flat in a void created between the upper tray 130 and lower tray 110.

Figure 6:
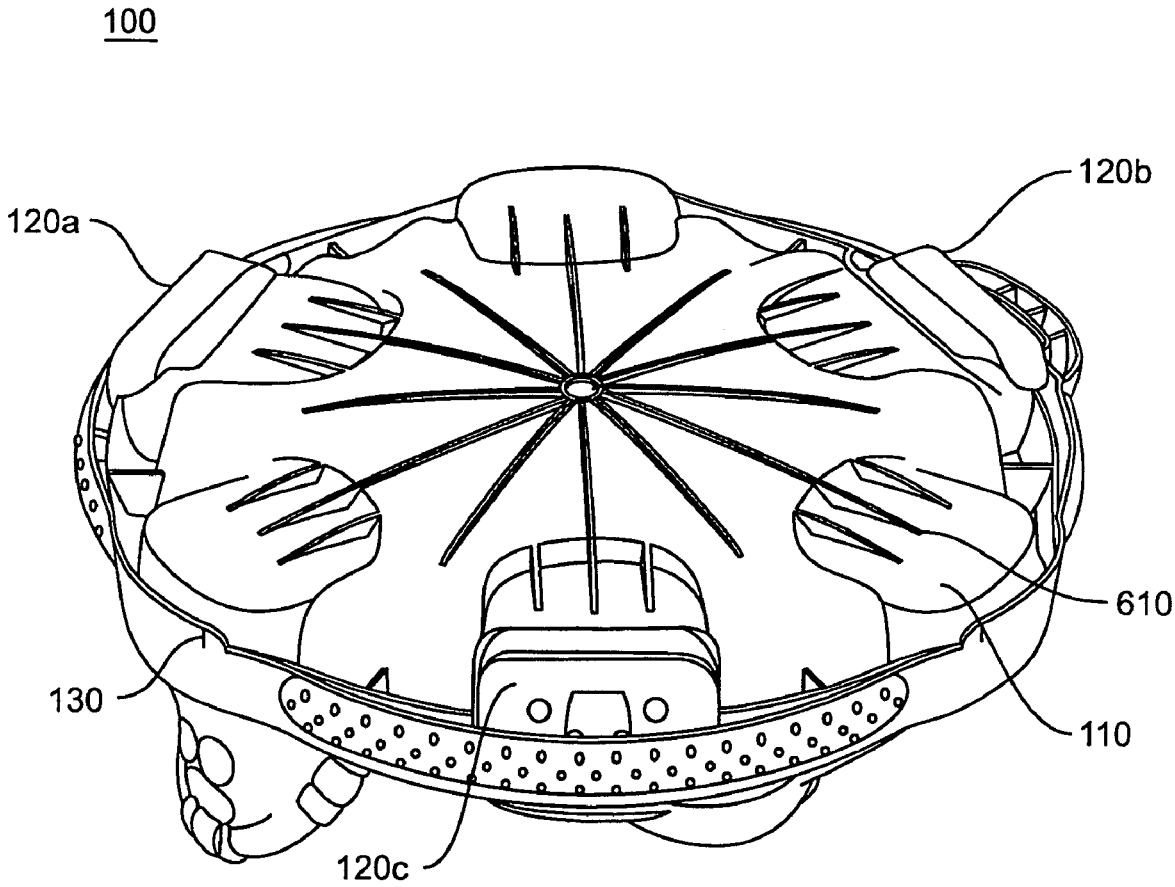
FIG. 6 is a plan view showing the underside of an embodiment of an interactive entertainer configured in a travel mode.

FIG. 6 is an underside view of an embodiment of the interactive entertainer 100 configured in travel mode. The view shows the legs 120*a*-120*c* pivoted inward and substantially the entire lower tray 110 nested within the upper tray 130. Additionally, the underside view shows ribs, for example 610, positioned on the underside of the lower tray 110 to provide the convex contour of the bottom of the lower tray 110 to allow the interactive entertainer 100 to rock when placed on a substantially flat surface.

Figure 7A:
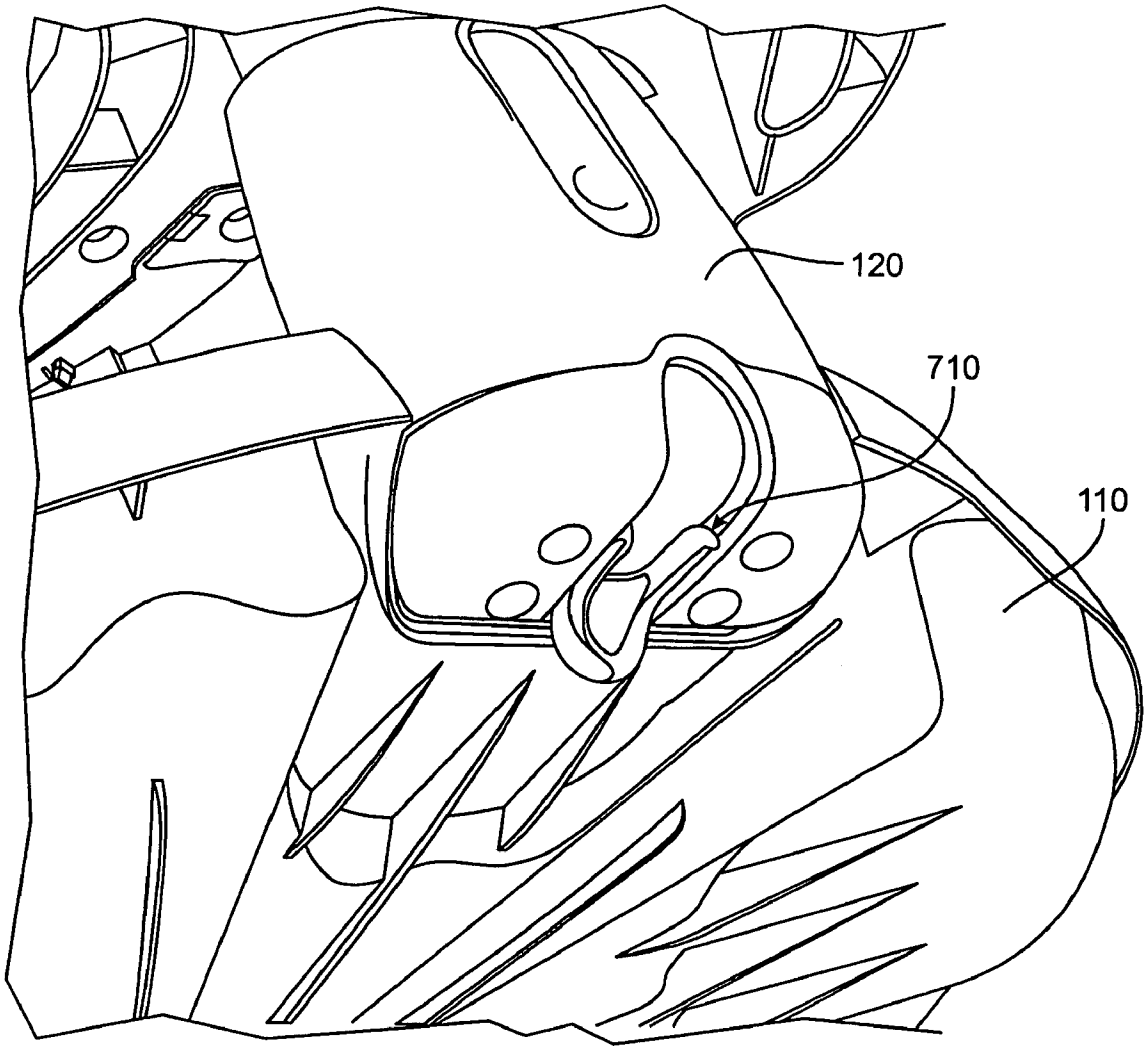
FIG. 7A is a detail of an embodiment of a support positioned in a stabilization configuration.

FIG. 7A is a detailed view of a portion of an embodiment of a leg 120. The leg 120 includes a repositionable support 710. The support 710 is shown positioned with a projection extending downward. The support 710 is configured such that the projection has a height that substantially prevents the interactive entertainer from rocking when positioned with the projection extending downward as shown in FIG. 7A. The support 710 can have a projection height that substantially compensates for the amount of curvature in the lower tray 110.

Figure 7B:
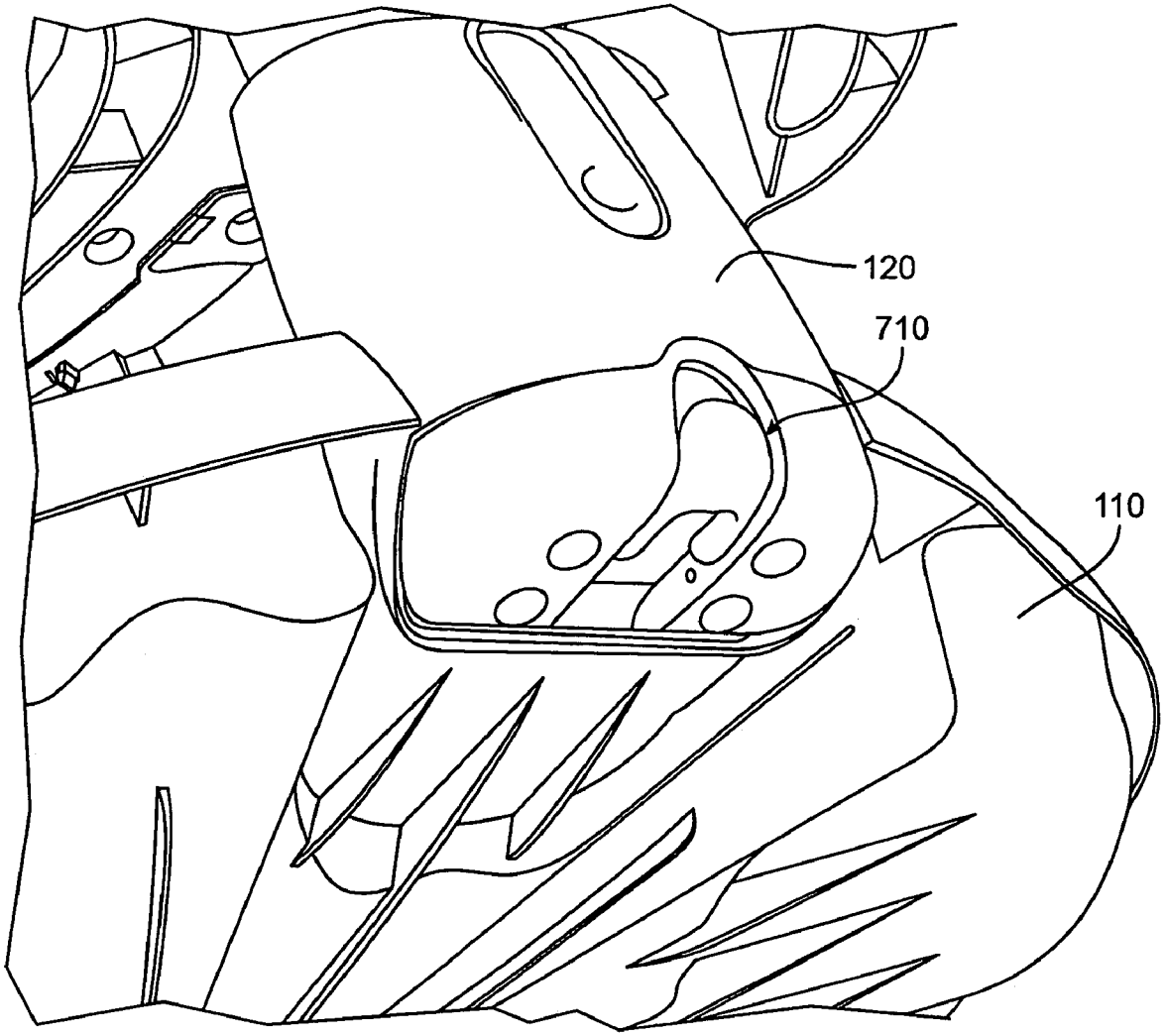
FIG. 7B is a detail of an embodiment of a support positioned in a rocking configuration.

FIG. 7B is a detailed view of a portion of an embodiment of a leg 120. The leg 120 includes the repositionable support 710 shown positioned such that rocking of the interactive entertainer is enabled. The support 710 can be repositioned from the orientation shown in FIG. 7A to the orientation shown in FIG. 7B by rotating the support 710 about a pivot point attaching the support 710 to the leg 120. Typically, a consumer would position the support 710 on each of the legs 120 to the same orientation to either prevent rocking or enable rocking of the interactive entertainer.

Figure 8A:
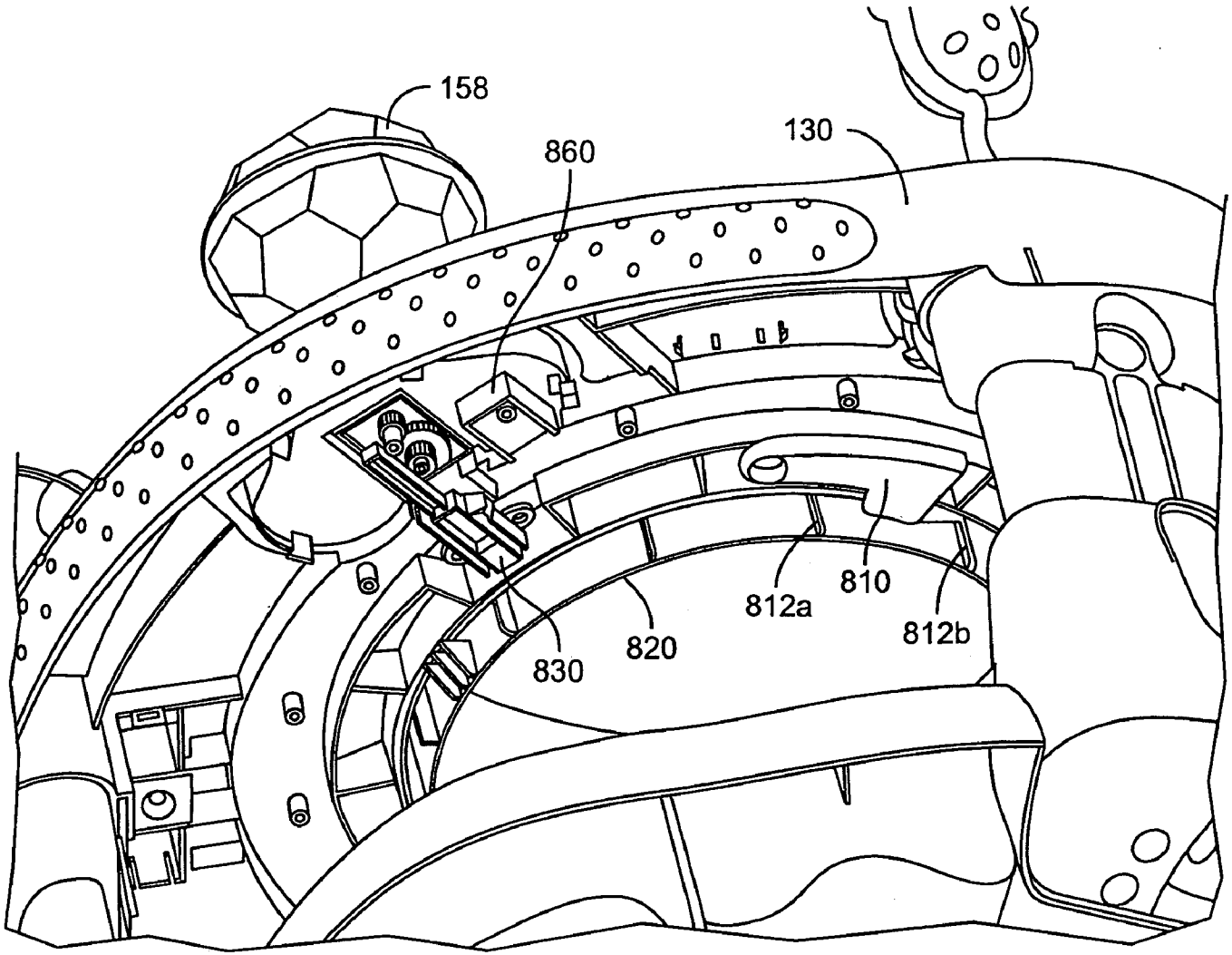
FIG. 8A is a detailed view of the underside of a portion of the top tray with a cover removed.

FIG. 8A is a detailed view of the underside of a portion of the upper tray 130. The seat is omitted from the figure for the sake of clarity. An embodiment of a seat lock 810 is located on the under side of the upper tray 130. The seat lock can be positioned to allow the seat to rotate, or can be positioned to inhibit seat rotation. In the embodiment shown in FIG. 8A, the seat lock 810 can be rotated such that a lock portion is located substantially against the seat ring 820. The seat ring 820 provides support for the seat and can be configured to rotate relative to the upper tray 130. A plurality of stops 812*a*-812*b* positioned around the seat ring 820 cooperate with the seat lock 810 to prevent, or substantially limit rotation of the seat and seat ring 820. The seat ring 820, and thus the seat, is allowed to rotate in a first direction until the seat lock encounters a first stop, for example 812*a*. The seat ring 820 is similarly allowed to rotate in the opposite direction until the seat lock 810 encounters a second stop, for example 812*b*. The spacing and number of stops 812*a*-812*b* can be varied to vary the position and range of rotation of the seat when the seat lock 810 is engaged.

The under side of the faceted globe 158 can also be seen in FIG. 8A. Protective covers are omitted from the figure to reveal an embodiment of a rotational coupler 830. The rotational coupler 830 couples the rotation of the seat to the faceted globe 158.

One or more sensors 860 can be positioned relative to each of the devices on the upper tray 130. A complementary pick-up or signal source (not shown) can be located on the seat ring or seat. In other embodiments, the seat ring may be passive and the sensor 860 may include both a signal source and signal detector. An example of such an embodiment includes a light source with an optical detector that can be configured to determine the position of the seat in part on a reflection of the light source off of the seat ring. Although optical sensors are described in detail, it is understood that the sensors can operate using any mechanical, electrical, optical mechanism, and the like, or a combination of such mechanisms. Different types of sensors are commercially available. The sensor 860 can be configured to determine an orientation of the seat, and therefore the child in the seat. One or more of the devices on the upper tray 130 can be configured to provide an output based in part on the orientation of the seat.

The output may be a prompt for the child to do something, or may relate to the particular device that the child is facing. For example, when the child sitting in the seat and the interactive entertainer is facing the microphone 156 in FIG. 1, the interactive entertainer may provide audio such as "Can you sing a song?" or "This is a microphone, please sing." When the child rotates to face, for example, the device 154 in FIG. 1 in the form of a numbered piano keyboard, the interactive entertainer may provide audio such as "Please press a number." or "Can you find the number 1?"

It is understood that embodiments of the invention are not limited to such outputs and the outputs can relate to any suitable subject matter. Audio outputs can relate to numbers, letters, phonics, words, colors, shapes, etc.

In other embodiments, the interactive entertainer can be configured to provide a visual output. A display device such as an LCD or an array of LEDs may optionally be incorporated into the entertainer to provide the user with visual feedback or output.

This feature is advantageous. Since the electronics in the interactive entertainer can automatically provide relevant feedback to a child using the interactive entertainer, the interactive entertainer appears to the child to "know" where the child is. This makes the interactive entertainer more fin and interactive than many commercially available saucers.

A sensor 860 is shown as located on the underside of the faceted globe 158. The sensor 860 can be used to determine that the seat is oriented towards the faceted globe 158. The interactive entertainer may then provide some sort of stimulus, such as an audio output or visual output. For example, one or more lights (not shown) may flash and an audio output may be played when the seat is oriented towards the faceted globe 158.

Figure 8B:
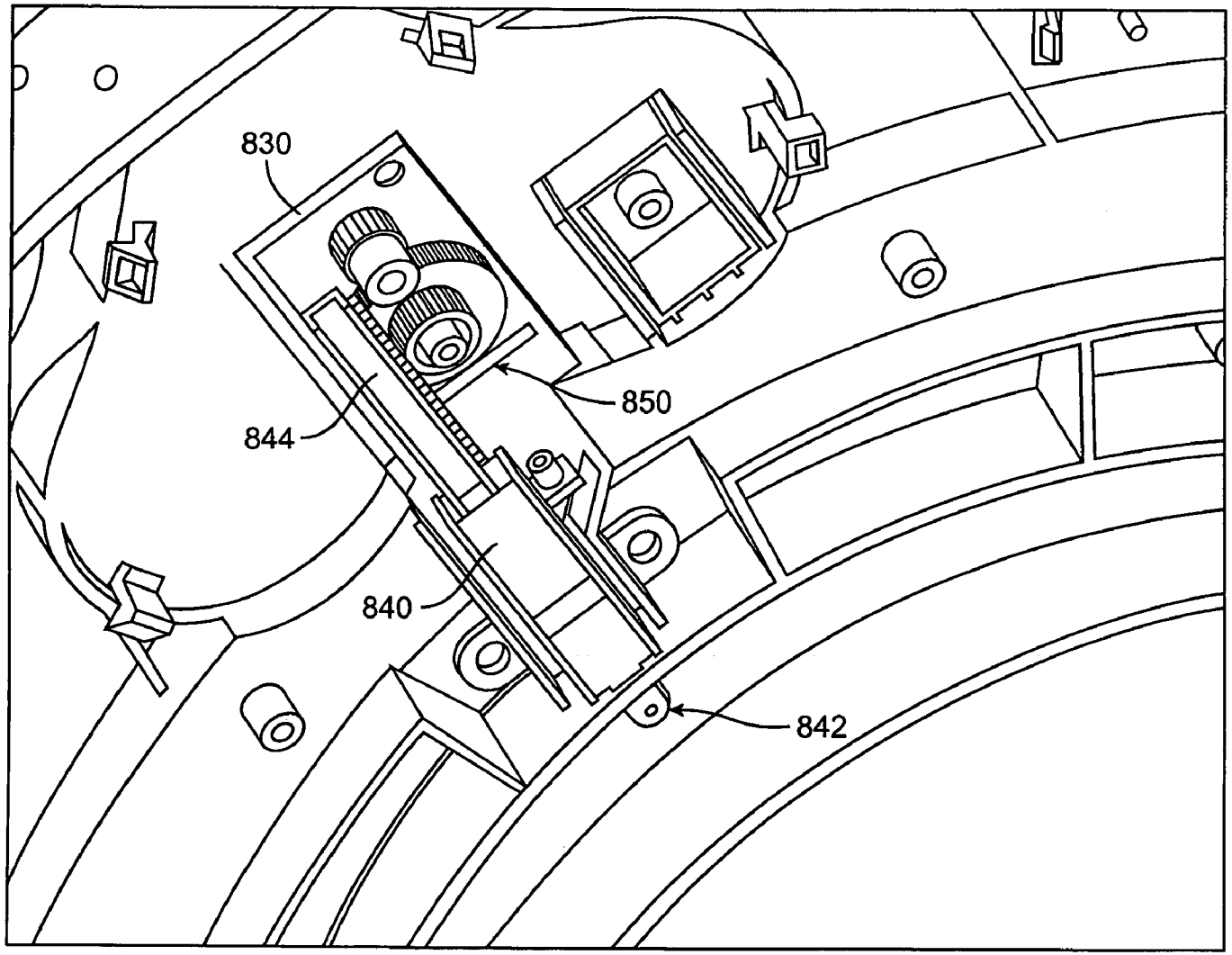
FIG. 8B is a detailed view of an embodiment of a rotational coupler.

FIG. 8B is a detailed view of an embodiment of the rotational coupler 830 of the faceted globe 158 of FIG. 8A. The embodiment of the rotational coupler 830 is configured as a contour follower that translates variations in the contour of the seat ring to linear motion. The linear motion is then translated to rotational motion that is used to spin the faceted globe.

The rotational coupler 830 includes a follower 840 that can be captured within a guide, channel, or bore, such that the follower 840 is substantially limited to motion along a single axis. The follower 840 has a roller 842 positioned on a first end. The roller 842 is configured to follow a contour or surface of the seat ring. Variations in the contour of the seat ring cause the follower 840 to move. Thus, as the seat ring is rotated, the roller 842 follows the contour variations in the seat ring, which causes displacement of the follower 840.

A drive portion 844 is positioned on a second end of the follower 840 substantially opposite the roller 842. The drive portion 844 includes teeth that are configured to engage with the teeth of a gear assembly 850. The gear assembly 850 can be configured to transform the linear motion of the follower 840 to rotational motion. The gear assembly 850 can be configured to amplify or reduce the rotation of an initial gear engaged with the drive portion 844.

Figure 9:
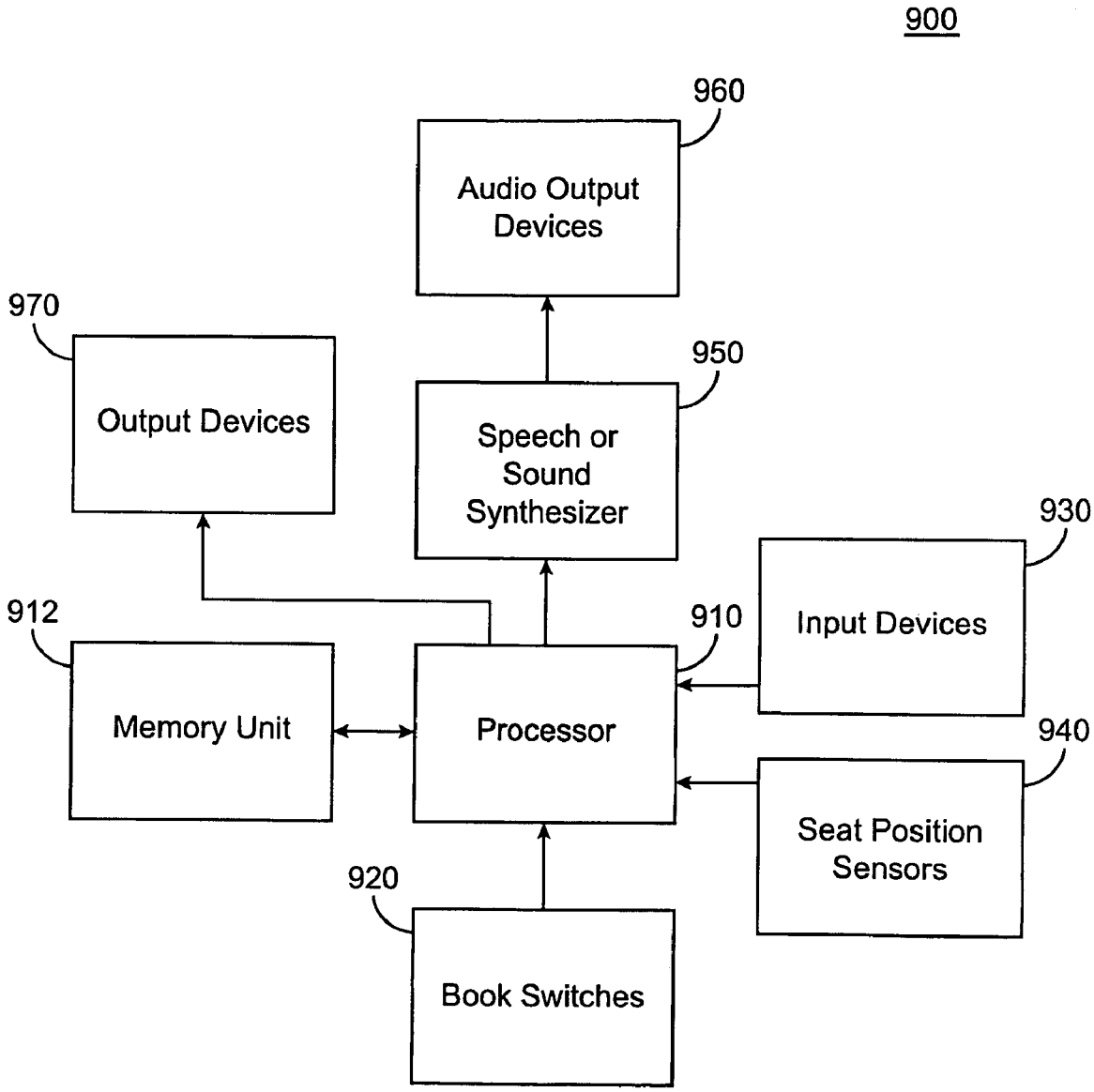
FIG. 9 is a functional block diagram of an embodiment of electronic components of an interactive entertainer.

FIG. 9 is a functional block diagram of an embodiment of an electronic assembly 900 within an interactive entertainer. The electronic assembly 900 can include a processor 910 coupled to a memory unit 912. The memory unit 912 can include, for example, one or more storage devices used by the processor 910. The one or more storage devices can include program memory, such as Read Only Memory (ROM) flash memory, non-volatile Random Access Memory (NV-RAM), optical memory, and the like, or some other storage device configured to store one or more processor readable instructions that, when executed by the processor 910 perform some of the functions of the interactive entertainer. The memory unit 912 can also include RAM or other temporary memory used by the processor 910.

The processor 910 can be configured to receive input from one or more devices, and can be configured to provide one or more outputs based on the inputs. The processor 910 can be coupled to book switches 920 that are integrated within an interactive book. The book switches can be configured, for example, to control an operational mode of the interactive entertainer. The processor 910 may provide a different output for the same device inputs depending on the position of the book switches 920.

The processor 910 can also be configured to receive inputs from one or more input devices 930. The input devices 930 can include, for example, switches or settings from one or more of the devices positioned on the upper tray of the interactive entertainer. The processor 910 can also be configured to receive inputs from one or more seat position sensors 940. The processor 910 can use the seat position sensors 940 to assist in determining the orientation of the seat.

The processor 910 can then control the outputs provided by one or more output devices 970. the output devices 970 can include, but are not limited to, visual output devices and mechanical output devices. Visual output devices can include lamps, LED lights, displays, and the like. Mechanical output devices can include controllable objects, such as motorized objects.

The processor 910 can also be coupled to one or more devices configured to provide audio output. For example, the processor 910 can be coupled to a speech or sound synthesizer 950 that is in turn coupled to an audio output device 960. The speech or sound synthesizer 950 may receive control signals or messages from the processor 910 and provide a corresponding audio output for the audio output device 960. Alternatively, or in addition, the speech or sound synthesizer can include a Digital to Analog Converter (DAC) that is configured to convert digital signals provided by the processor 910 into analog signal to be output by an audio output device 960, such as a speaker. In other embodiments, the speech or sound synthesizer 950 may be omitted and the processor 910 may provide an output directly to the audio output device 960. The audio output device 960 can include one or more output devices and can include a speaker, piezoelectric device, buzzer, bell, ringer, and the like, or some other device for audio output.

Figure 10A:
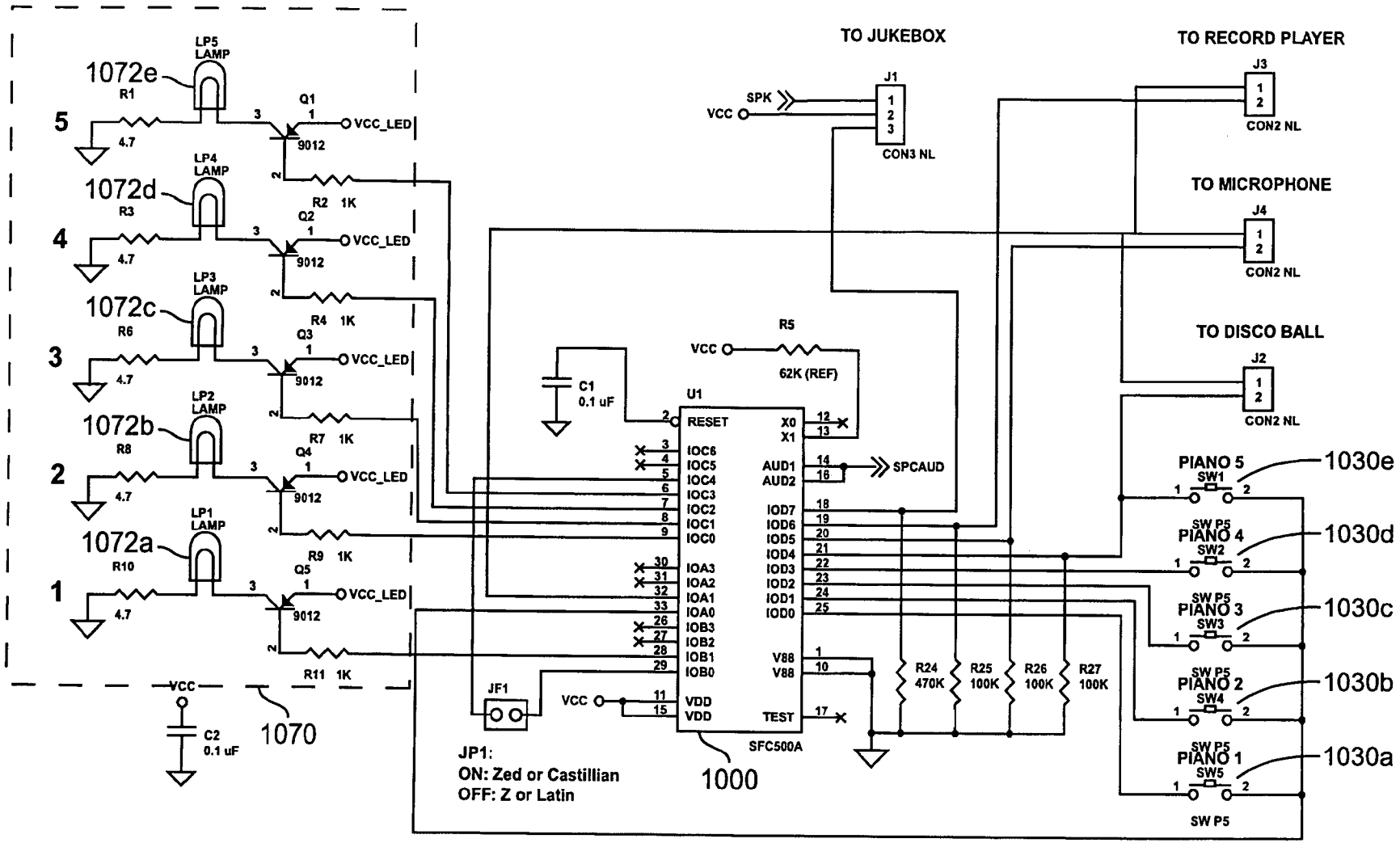
FIGS. 10A-10C are schematic diagrams of an embodiment of electronic components of an interactive entertainer.
Figure 10B:
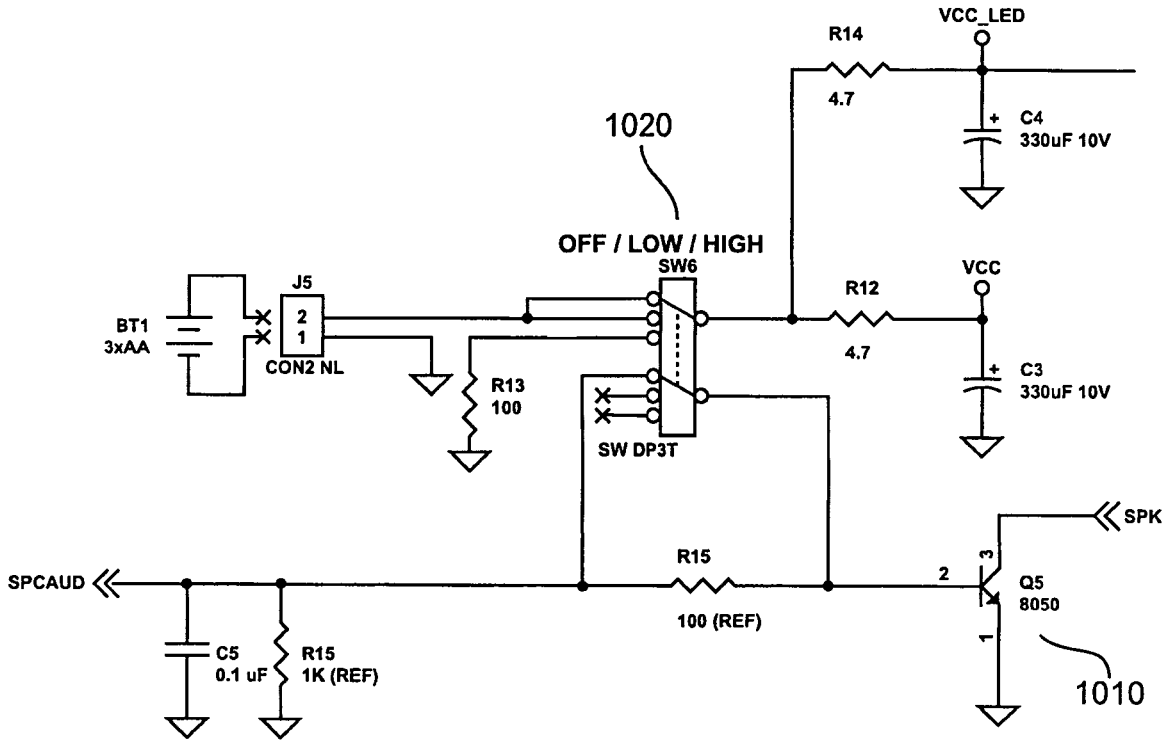
Figure 10C:
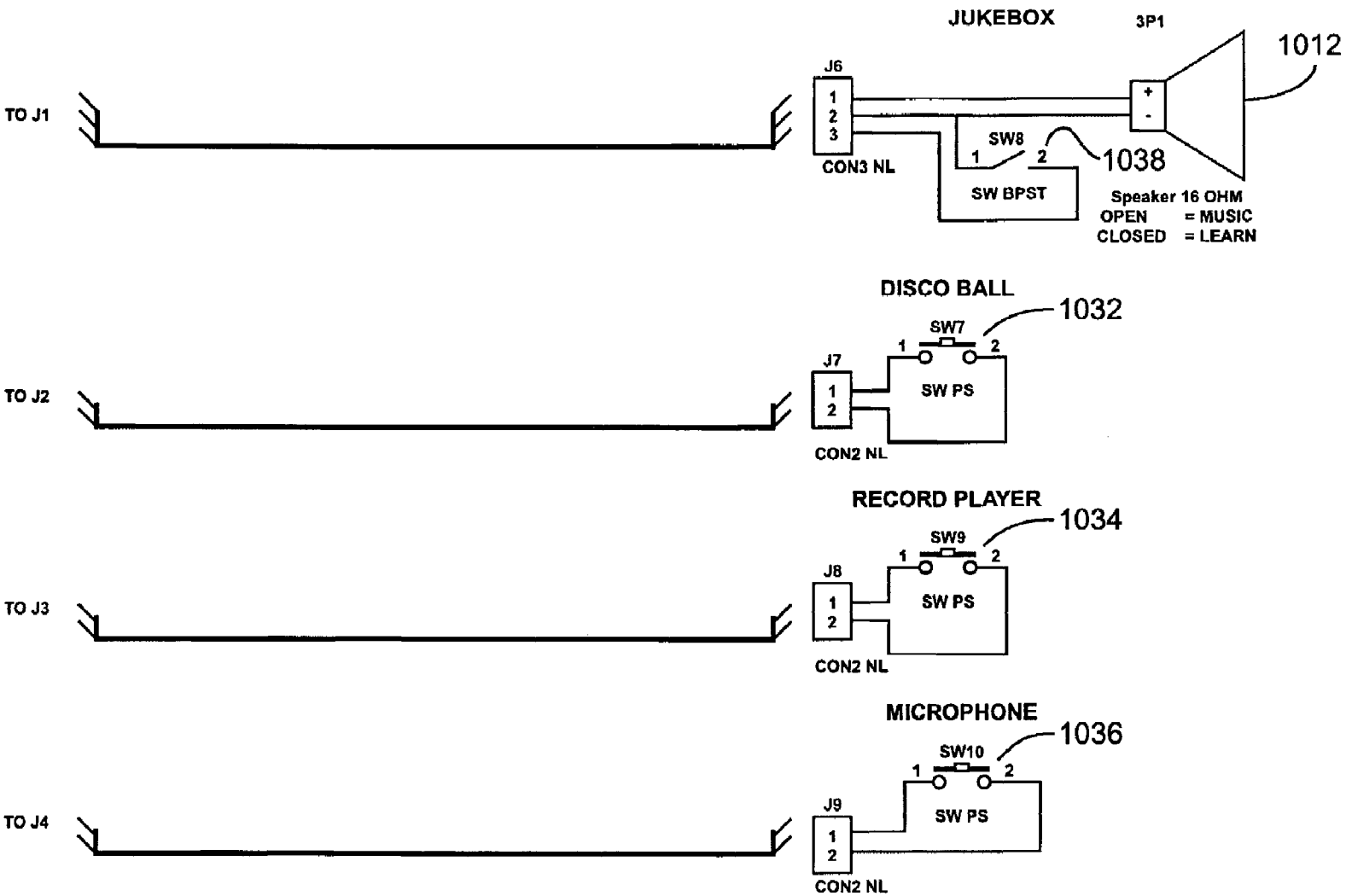

FIGS. 10A-10C is a schematic diagram of an electronics assembly, which can be, for example, the electronics assembly of FIG. 9. FIG. 10A shows an control integrated circuit (IC) 1000 that may include the processor and memory unit of FIG. 9. The control IC 1000 can be, for example, an Application Specific Integrated Circuit (ASIC), a hybrid device, a microcontroller, and the like, or some other control device. The control IC 1000 includes a plurality of input and output lines or ports. A first set of output lines can be coupled to a visual output 1070 that includes a plurality of lamps 1072*a*-1072*e* that can be individually controlled by the control IC 1000.

A first set of input lines to the control IC 1000 can be coupled to a first input device, which may be a keyboard or keypad. The keyboard is shown as having five switches 1030*a*-1030*e* corresponding to five separate keys on the keyboard. Additional input lines are coupled to switches in the interactive book 1038, simulated record player 1034, disco ball 1032, and simulated microphone 1036 shown on FIG. 10C.

Audio output from the control IC 1000 is coupled to an amplifier 1010 shown in FIG. 10B. An ON/OFF switch 1020 is configured to couple the electronics to one or more batteries or some other type of power supply. The switch 1020 is also configured to modify the audio signal level coupled from the control IC 1000 to the amplifier 1010 to vary the amplitude of the audio output. The output of the amplifier 1010 is coupled to a speaker 1012 shown on FIG. 10C.

Descriptions of various embodiments of an interactive entertainer and method of implementing an interactive entertainer are provided. The interactive entertainer can include an upper tray supported by legs coupled to a lower tray. The lower tray can be a saucer style base that rocks. The supports between the lower and upper trays can be height adjustable and can be compliant or spring loaded to allow for bouncing. The upper tray can support a rotatable seat and can have one or more devices positioned around the seat.

The interactive entertainer can provide to a user positioned in the seat an interactive experience that encourages cause and effect learning through mobility and rhythm. The interactive entertainer can include devices that feature multiple styles of music, lights, speech and touch that may advantageously stimulate a pre-walking baby.

An interactive device, such as an interactive book, can allow the user to change the operational mode of the interactive entertainer. The operational mode of the interactive entertainer can be controlled by the page displayed by the interactive book. In one embodiment, there are two modes: learning and music. In the learning mode, the interactive entertainer can introduce letters, numbers, colors, high and low voice modulation, and other age appropriate concepts through music. In the music mode, the interactive entertainer can teach cause and effect by configuring each of the devices on the upper tray with a corresponding sound. The interactive entertainer can also teach audio differentiation using multiple different styles of music.

The interactive entertainer can be collapsed to a reduced form factor to facilitate transport and storage. To configure the interactive entertainer for a compact travel mode, the upper tray is collapsed to a position near the lower tray, and nearer to the lower tray than in any mode of use. The lower tray can, for example, substantially nest within the upper tray in the travel mode. The legs can fold to lie within a void between the upper and lower trays. In one embodiment, the travel mode is approximately 40% the volume of the entertainer when assembled for use.

This is particularly advantageous for parents who do not have a large vehicle such as a van and might want to carry the interactive entertainer to another place where the child is to be entertained (for example, a day care facility). For example, unlike conventional saucers, the interactive entertainer according to embodiments of the invention can fit into the trunk of a standard mid-size sedan.

The above description of the disclosed embodiments is provided to enable any person of ordinary skill in the art to make or use the disclosure. Various modifications to these embodiments will be readily apparent to those of ordinary skill in the art, and the generic principles defined herein may be applied to other embodiments without departing from the spirit or scope of the disclosure. Thus, the disclosure is not intended to be limited to the embodiments shown herein but is to be accorded the widest scope consistent with the principles and novel features disclosed herein.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

What is claimed is:

1. An interactive entertainer comprising:

a lower tray;

a seat;

an upper tray disposed around at least a portion of the seat and disposed above the lower tray, the upper tray rotatably coupled to the seat and configured to allow the seat to rotate relative to the upper tray; and a plurality of legs, each of the plurality of legs pivotably coupled to at least one of the upper tray and lower tray, the interactive entertainer capable of being transformed from an activity mode to a storage mode by radially pivoting at least a portion of the legs to collapse the upper tray towards the lower tray to reduce the overall dimensions of the interactive entertainer, wherein the lower tray nests at least partially within the upper tray in the storage mode.

2. The interactive entertainer of claim 1, wherein the plurality of legs are coupled to the lower tray, the plurality of legs supporting the upper tray in the activity mode and configured to fold inward in the storage mode.

3. The interactive entertainer of claim 1, wherein the plurality of legs are pivotably coupled to the lower tray and releasably coupled to the upper tray at a plurality of leg attachments on the upper tray, and wherein the lower tray comprises a plurality of nesting areas configured to receive the leg attachments in the storage mode.

4. The interactive entertainer of claim 1, further comprising a seat lock coupled to the upper tray and configured to selectively limit rotation of the seat relative to the upper tray when engaged.

5. The interactive entertainer of claim 1, further comprising a plurality of supports selectively configurable to extend beneath a portion of the lower tray, and wherein the lower tray comprises a substantially concave lower surface relative to the upper tray to allow the interactive entertainer to rock when the plurality of supports do not extend beneath the portion of the lower tray, and wherein rocking of the interactive entertainer is substantially impeded when the plurality of supports are positioned to extend beneath the portion of the lower tray.

6. The interactive entertainer of claim 1, further comprising a handle coupled to the upper tray and accessible at least in the storage mode.

7. An interactive entertainer comprising:

a lower tray;

a seat;

an upper tray disposed around at least a portion of the seat and disposed above the lower tray, the upper tray rotatably coupled to the seat and configured to allow the seat to rotate relative to the upper tray;

a plurality of legs, each of the plurality of legs pivotably coupled to at least one of the upper tray and lower tray, the interactive entertainer capable of being transformed from an activity mode to a storage mode by radially pivoting at least a portion of the legs to collapse the upper tray towards the lower tray to reduce the overall dimensions of the interactive entertainer;

a plurality of compressible leg attachments coupled to the upper tray; and the plurality of legs are pivotably coupled to the lower tray and supporting the upper tray at the leg attachments, each of the plurality of legs having a leg extension adapted to extend from the leg to any one of a plurality of distances.

8. An interactive entertainer comprising:

means for rotatably supporting a seat;

means for positioning a plurality of devices around the seat;

means for sensing an orientation of the seat; and means for activating at least one of the plurality of devices based in part on the orientation of the seat.

9. An interactive entertainer comprising:

a seat;

a tray disposed around at least a portion of the seat;

at least one interactive device positioned on the tray;

an interactive book having at least one page and positioned on the tray and coupled to the at least one interactive device; and a book switch integrated within the interactive book, wherein turning the page of the interactive book operates the book switch and changes an operational mode of the interactive entertainer.

10. The interactive entertainer of claim 9, wherein the operational mode comprises at least two operational modes.

11. The interactive entertainer of claim 9, wherein the operational mode comprises a learning mode and a music mode.

12. The interactive entertainer of claim 9, wherein a page face includes an image corresponding to the operational mode.

13. The interactive entertainer of claim 9, further comprising:

a memory unit configured to store processor usable instructions for each of a plurality of operational modes; and a processor coupled to each of the interactive book and at least one interactive device, the processor configured to determine the operational mode based at least in part on a position of the page on the interactive book, and based on the operational mode, further configured to access a portion of the processor usable instructions in response to an input from the at least one interactive device.

14. The interactive entertainer of claim 9, wherein the at least one interactive device comprises at least one of a keyboard, a simulated record player, and a microphone.

15. An interactive entertainer comprising:

a seat;

a tray disposed around at least a portion of the seat and rotatably coupled to the seat to allow the seat to rotate relative to the tray;

at least one device positioned on the tray; and a sensor configured to monitor at least a portion of the seat and configured to determine an orientation of the seat.

16. The interactive entertainer of claim 15, further comprising a processor configured to activate a device from the at least one device based in part on the orientation.

17. The interactive entertainer of claim 15, further comprising a processor configured to deactivate a device from the at least one device based in part on the orientation.

18. An interactive entertainer comprising:

a seat;

a tray disposed around at least a portion of the seat and rotatably coupled to the seat to allow the seat to rotate relative to the tray; and at least one device, including a faceted globe, positioned on the tray; and a rotational coupler configured to rotate the at least one device based in part on rotation of the seat.

19. An interactive entertainer comprising:

a seat;

a tray disposed around at least a portion of the seat and rotatably coupled to the seat to allow the seat to rotate relative to the tray;

at least one device positioned on the tray and configured to rotate based in part on rotation of the seat; and a rotational coupler configured to mechanically couple the seat to the at least one device.

20. An interactive entertainer comprising:

a seat comprising a perimeter with a varying contour;

a tray disposed around at least a portion of the seat and rotatably coupled to the seat to allow the seat to rotate relative to the tray;

at least one device positioned on the tray and configured to rotate based in part on rotation of the seat; and a rotational coupler comprising:

a follower;

a roller positioned on a first end of the follower and configured to ride on the varying contour of the seat;

a drive portion positioned on a second end of the follower substantially opposite the roller, the drive portion including teeth; and a gear assembly coupled to the at least one device and having one or more gears configured to engage with the teeth of the drive portion.

21. A method of configuring an interactive entertainer to a travel mode, the method comprising:

releasing an upper tray supporting a rotatable seat and at least one interactive device from at least one support;

configuring the at least one support for the travel mode;

collapsing the upper tray towards a lower tray comprising rotating the upper tray a predetermined amount and nesting at least a portion of the lower tray within the upper tray; and coupling the upper tray to the lower tray when collapsed to configure the interactive entertainer to the travel mode.

22. The method of claim 21, wherein releasing the upper tray comprises releasing at least one leg attachment on the upper tray from at least one leg coupled to the lower tray.

23. The method of claim 21, wherein configuring the at least one support for the travel mode comprises folding inward at least a portion of a plurality of legs coupled to the lower tray.

* * * * *